US005512110A

United States Patent [19]

Yoshitomi et al.

[11] Patent Number: 5,512,110

[45] Date of Patent: Apr. 30, 1996

[54] PROCESS FOR PRODUCTION OF GRAIN ORIENTED ELECTRICAL STEEL SHEET HAVING EXCELLENT MAGNETIC PROPERTIES

[75] Inventors: Yasunari Yoshitomi; Katsuro Kuroki; Yukio Matsuo; Hiroaki Masui; Yoshio Nakamura; Maremizu Ishibashi; Tsuyoshi Kawano; Tsutomu Haratani, all of Kitakyushu; Yoshiyuki Ushigami, Futtsu, all of Japan

[73] Assignee: Nippon Steel Corporation, Tokyo, Japan

[21] Appl. No.: 466,866

[22] Filed: Jun. 6, 1995

Related U.S. Application Data

[63] Continuation of Ser. No. 48,393, Apr. 14, 1993, abandoned.

[30] Foreign Application Priority Data

| | | | |
|---|---|---|---|
| Apr. 16, 1992 | [JP] | Japan | 4-096858 |
| Apr. 16, 1992 | [JP] | Japan | 4-096859 |
| Apr. 24, 1992 | [JP] | Japan | 4-107001 |

[51] Int. Cl.[6] ..... H01F 1/18

[52] U.S. Cl. ..... 148/113; 148/111

[58] Field of Search ..... 148/111, 112, 148/113

[56] References Cited

FOREIGN PATENT DOCUMENTS

| | | |
|---|---|---|
| 0326912 | 8/1989 | European Pat. Off. . |
| 0390142 | 10/1990 | European Pat. Off. . |
| 0390140 | 10/1990 | European Pat. Off. . |
| 0400549 | 12/1990 | European Pat. Off. . |
| 40-15644 | 7/1965 | Japan . |
| 51-13469 | 4/1976 | Japan . |
| 52-24116 | 2/1977 | Japan . |
| 54-24685 | 8/1979 | Japan . |
| 57-89433 | 6/1982 | Japan . |
| 57-158322 | 9/1982 | Japan . |
| 59-56522 | 4/1984 | Japan . |
| 59-190324 | 10/1984 | Japan . |

OTHER PUBLICATIONS

European Patent Office Search Report EP 93106124.6.

*Primary Examiner*—John Sheehan
*Attorney, Agent, or Firm*—Kenyon & Kenyon

[57] ABSTRACT

In the present invention, grain oriented electrical steel sheets provided by heating a slab comprising, by weight percent, 0.025 to 0.075% of C, 3.4 to 5.0% of Si, 0.015 to 0.080% of sol. Al, 0.0030 to 0.013% of N, 0.014% or less of (S+0.405 Se) and 0.05 to 0.8% of Mn, sol. Al (%)/Si (%) being 0.0080 or more, the balance consisting of Fe and unavoidable impurities at a temperature below 1280° C., hot-rolling the heated slab, subjecting the hot-rolled steel sheet to cold rolling, subjecting the cold-rolled steel sheet to decarbonization annealing with regulating the average diameter of primary recrystallized grains of the steel sheet subjected to decarbonization annealing to 18 to 35 μm in a period between the completion of the decarbonization annealing and the initiation of final annealing, coating the decarburized steel with an annealing separator and subjecting the coated steel sheet to final annealing, wherein the final annealing is effected in such a manner that the partial pressure of nitrogen, $P_{N2}$(%), in the annealing atmosphere is 12.5% or more in a steel sheet temperature range of from 900° C. to 1150° C. in the heating stage of the final annealing, and subjecting the steel sheet to nitriding to cause the steel sheet to absorb 0.0010% by weight or more of nitrogen in a period between the completion of the hot rolling and the initiation of secondary recystallization in the final annealing.

10 Claims, 5 Drawing Sheets

PROCESS FOR PRODUCTION OF GRAIN ORIENTED ELECTRICAL STEEL SHEET HAVING EXCELLENT MAGNETIC PROPERTIES

This application is a continuation of application Ser. No. 08/048,393 filed Apr. 14, 1993 now abandoned.

BACKGROUND OF THE INVENTION

1. Field of the Invention

The present invention relates to a process for producing a grain oriented electrical steel sheet having excellent magnetic properties for use as an iron core for transformers or the like.

2. Description of the Prior Art

A grain oriented electrical steel sheet is used mainly as an iron core material for transformers and other electrical equipment and should be excellent in magnetic properties, such as an excitation property and an iron loss property. The magnetic flux density, $B_8$, at a magnetic field strength of 800 A/m is usually used as a numerical value for expressing the excitation property. The iron less per kg obtained when the steel sheet is magnetized to 1.7 tesla (T) at a frequency of 50 Hz, i.e., $W_{17/50}$, is used as a numerical value for expressing the iron less property. The magnetic flux density is the most dominant factor for the iron loss property. In general, the higher the magnetic flux density, the better the iron loss property. In some cases, an increase in the magnetic flux density causes the size of the secondary recrystallized grain to be increased, so that the iron loss becomes poor. Even in this case, the iron loss property can be improved independently of the grain diameter of the secondary recrystallized grain by using the magnetic domain control.

The grain oriented electrical steel sheet is produced by causing a secondary recrystallization in the final annealing to develop the so-called "Goss texture" having a <001> axis in the rolling direction and a {110} plane on the surface of the steel sheet. In order to obtain good magnetic properties, it is necessary to highly arrange the <001> axis which is an easily magnetizable axis in the same rolling direction.

Representative examples of the process for producing the above-described grain oriented electrical steel sheet having a high magnetic flux density include a process disclosed in Japanese Examined Patent Publication (Kokoku) NO. 40-15644 by Satoru Taguchi et al., and a process disclosed in Japanese Examined Patent Publication (Kokoku) No. 51-13469 by Takuichi Imanaka et al. In the former, MnS and AlN are used mainly as an inhibitor, while in the latter, MnS, MnSe, Sb, etc., are used mainly as the inhibitor. Therefore, in the current technique, it is requisite to properly control the size, form and dispersed state of the precipitate which functions as the inhibitor. With respect to MnS, in the current process, MnS is once completely dissolved in a solid solution form during heating of the slab before hot rolling, and precipitation of MnS is conducted during hot rolling. In order to completely dissolve MnS having an amount necessary for causing the secondary recrystallization, a temperature of about 1400° C. is necessary. This temperature is at least 200° C. above the slab heating temperature of common steels. The slab heating treatment at a high temperature has the following disadvantages.

1) It is necessary to use a high temperature slab heating furnace for exclusive use in the grain oriented electrical steel.

2) An energy unit of the slab heating furnace is high.

3) The amount of molten scale increases, which has a large adverse effect on the operation, such as the necessity of raking out slag from the slab heating furnace.

The above-described problems can be avoided by lowering the slab heating temperature to that used in common steels. This, however, means that MnS effective as the inhibitor is used in a reduced amount or is not used at all, which inevitably renders the secondary recrystallization unstable. For this reason, in order to realize the heating of the slab at a low temperature, it is necessary to strengthen the inhibitor with a precipitate other than MnS for the purpose of sufficiently inhibiting the growth of normal grains during final annealing. Sulfides and further nitrides, oxides, grain boundary segregation elements, etc., are considered effective as the above-described inhibitor, and the following are examples of known techniques associated therewith.

Japanese Examined Patent Publication (Kokoku) No. 54-24685 discloses a method wherein the slab heating at a temperature in the range of from 1050° to 1350° C. is made possible by incorporating, in the steel, a grain boundary segregation element, such as As, Bi, Sn or Sb. Japanese Unexamined Patent Publication (Kokai) No. 52-24116 discloses a method wherein the slab heating at a temperature in the range of from 1100° to 1260° C. is made possible by incorporating, in the steel, a nitride forming element, such as Zr, Ti, B, Nb, Ta, V, Cr or Mo, in addition to Al. Japanese Unexamined Patent Publication (Kokai) No. 57-158322 discloses a method wherein the heating of a slab at a low temperature is made possible by lowering the Mn content so as to have a Mn/S ratio of 2.5 or less and, at the same time, the secondary recrystallization is stabilized by adding Cu. Further, a method wherein the strengthening of the inhibitor is combined with an improvement in the metallic structure has also been disclosed. Specifically, in Japanese Unexamined Patent Publication (Kokai) No. 57-89433, the heating of the slab at a low temperature of 1100° to 1250° C. is made possible by combining the addition of Mn and an additional element, such as S, Se, Sb, Bi, Pb, Sn or B, with the percentage columnar crystal of the slab and the reduction ratio in the second cold rolling of the slab. Further, Japanese Unexamined Patent Publication (Kokai) NO. 59-190324 discloses a method of stabilizing the secondary recrystallization which comprises providing an inhibitor composed mainly of S or Se and Al and B and nitrogen and subjecting the inhibitor to pulse annealing at the time of the primary recrystallization annealing after cold rolling. Thus, a great effort has hitherto been made to enable the slab to be heated at a low temperature in the production of grain oriented electrical steel sheets.

The above-described Japanese Unexamined Patent Publication (Kokai) No. 59-56522 discloses that a slab can be heated at a low temperature when the contents of Mn and S are 0.08 to 0.45% and 0.007% or less, respectively. This method has solved the problem of occurrence of a linear poor secondary recrystallization of products attributable to the coarsening of slab grains during heating of the slab at a high temperature.

However, the method wherein the slab is heated at a low temperature aims primarily at lowering the production cost, and it is a matter of course that commercialization cannot be realized unless the technique enables good magnetic properties to be stably obtained.

An object of the present invention is to provide a technique which enables good magnetic properties to be stably obtained on the condition that the heating of the slab is effected at a low temperature.

SUMMARY OF THE INVENTION

In order to attain the above-described object, the present inventors have made extensive studies on the chemical components, production process, etc., of the above-described electrical steel sheet. As a result, they have found that it is important to (1) increase the Si content, (2) reduce the sheet thickness and (3) smooth the surface, and, in order to satisfy these requirements, they have developed techniques including:

(1) a technique which enables the Si content to be increased and, at the same time, a sharp {110}<001> in the secondary recrystallized texture to be ensured by increasing the Al content or increasing the partial pressure of nitrogen in an annealing atmosphere in a temperature region where the secondary recrystallization proceeds;

(2) a technique wherein, in order to more stably attain a proper reduction ratio in the final cold rolling, pre-cold rolling is effected with a proper reduction ratio followed by annealing while avoiding the occurrence of recrystallization as much as possible; and (3) a technique wherein the surface of the steel sheet is smoothed by using an annealing separator less reactive with $Si_{02}$.

More specifically, the subject matter of the present invention is as follows. The process for producing a grain oriented electrical steel sheet according to the present invention is realized on the premise that nitriding is effected in a period between the completion of hot rolling and the initiation of the secondary recrystallization in the final annealing. In this connection, the present inventors have found that an increase in the Si content renders the nitride Si-rich during the progress of the secondary recrystallization, so that the nitride becomes liable to decompose. This tendency causes the lowering in the effect of the inhibitor to enhance the special grain boundary migration characteristics during secondary recrystallization. This is because the special grain boundary characteristics (a characteristics such that the coincidence grain boundary is more mobile than the general grain boundary) in the grain boundary migration is reduced, which leads to the occurrence of secondary recrystallization also in oriented grains dispersed from the {110}<001> orientation, so that the magnetic flux density unfavorably lowers. In order to solve this problem, the present invention provides techniques including ① a technique wherein the Al content is increased with the increase in the Si content to stably precipitate AlN, and ② a technique wherein the partial pressure of nitrogen in an annealing atmosphere in a secondary recrystallization temperature region is increased with the increase in the Si content to prevent the decomposition of the nitride. These techniques enable an increase in the Si content and a high magnetic flux density to be simultaneously realized.

It is known that the secondary recrystallized grains of the grain oriented electrical steel sheet is evolved through the process that grains having a {110}<001> orientation formed on the surface layer of the steel sheet grow through the sheet thickness. Further, in order to realize a high magnetic flux density, it is necessary to regulate the reduction ratio of the final cold rolling in a proper range and to obtain proper amounts of grains having a sharp {110}<001> orientation and coincidence oriented grains (such as grains having a {111}<112> orientation) in relation to {110}<001> orientation in the primary recrystallized steel sheet after decarbonization annealing. In production process wherein AlN is used as a main inhibitor, the proper reduction ratio of the final cold rolling is 80% or more. On the other hand, when a steel sheet product having a thin gage of 0.10 to 0.25 mm is produced, in order to realize this proper reduction ratio of cold rolling by one stage cold rolling, a hot rolled sheet having a thickness of 1 to 2 mm is necessary. Since it is difficult to stably produce this thin hot rolled sheet in a good shape, the regulation of the thickness of the hot rolled sheet to a proper thickness in the subsequent preliminary cold rolling is desired for the purpose of producing a thin steel sheet with good magnetic properties. The proper reduction ratio of the preliminary cold rolling is regulated in such a range as will be less liable to cause recrystallization in the annealing subsequent to the preliminary cold rolling, that is, in the range of from 10 to 50%.

In usual grain oriented electrical steel sheets, forsterite ($Mg_2SiO_4$) is formed on the surface thereof, and a tension coating is further formed on the forsterite. During temperature elevation in the final annealing, the forsterite is formed as a result of a reaction of $SiO_2$ formed in the vicinity of the surface during decarbonization annealing with MgO coated as an annealing separator. The forsterite serves to impart tension to the steel sheet, which contributes to an improvement in the iron loss property. Since, however, the interface of the forsterite and the matrix is uneven, when steel sheet is magnetized, the migration of the magnetic domain wall is inhibited. This is causative of the deterioration in the iron loss property.

The above-described effect of tension attained by the forsterite can be attained also by providing a tension coating. Accordingly, in order to eliminate the above-described factors causative of the deterioration in the iron loss property, the present inventors have developed (1) a method wherein $Mg_2SiO_2$ is once formed and then peeled off from the matrix and (2) a method for avoiding the formation of $Mg_2SiO_2$. The method (1) is realized by adding an annealing separator comprising MgO as a main component and, added thereto, at least one member selected from the group consisting of chlorides, nitrates, sulfides and sulfates of Li, K, Na, Ba, Ca, Mg, Zn, Fe, Zr, Sr, Sn and Al. The method (2) is realized by using as an annealing separator a powder of a substance nonreactive or less reactive with Si02, such as $Al_2O_3$, $SiO_2$, $ZrO_2$, BaO, CaO or SrO, instead of MgO.

The use of these techniques, either alone or in combination, enables grain oriented electrical steel sheets having a very good iron loss property unattainable in the prior art to be stably provided.

DESCRIPTION OF THE PREFERRED EMBODIMENTS

The grain oriented electrical steel sheet contemplated in the present invention is produced by subjecting a molten steel produced according to a conventional steel making process to casting by a continuous casting process or an ingot making process, forming a slab with the step of blooming being optionally provided between the casting and the preparation of the slab, hot-rolling the slab to form a hot-rolled sheet, optionally annealing the hot-rolled sheet, subjecting the sheet to cold rolling including final cold rolling with a reduction ratio of 80% or more (optionally conducting cold rolling twice or more with an intermediate annealing being effected between the cold rollings) and then successively subjecting the cold-rolled sheet to decarbonization annealing and final annealing. In connection with the above-described process, the present inventors have made extensive studies from various points of view on the regulation of the orientation of secondary recrystallized grains where the Si content is increased and, as a result, have found that the ratio of Al content to Si content is an important factor. This will now be described in more detail with reference to the following the experimental results.

Figure 1:
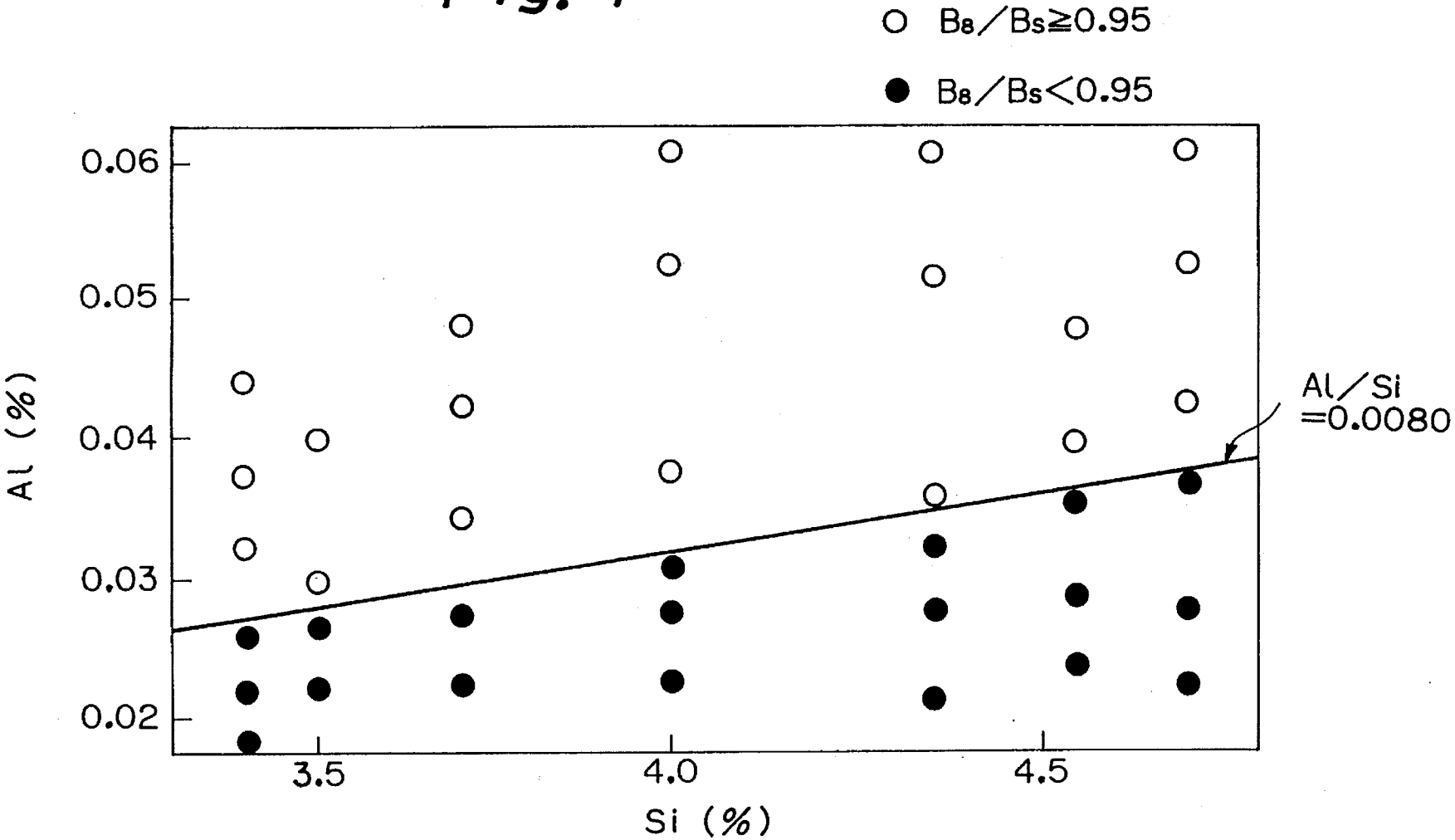
FIG. 1 is a graph showing the relationship between the Al/Si range and the magnetic property.

FIG. 1 is a graph showing the relationship between the ratio of Si content to Al content (Al/Si) and the magnetic property. In the drawing, the acid sol. Al content is expressed as Al (%). In this case, a 40 mm-thick slab comprising 0.045 to 0.067% by weight of C, 3.4 to 4.7% by weight of Si, 0.018 to 0.061% by weight of acid sol. Al, 0.0073 to 0.0092% by weight of N, 0.14% by weight of Mn and 0,006 to 0.008% by weight of S with the balance consisting of Fe and unavoidable impurities was heated to 1150° C. for one hour and then hot-rolled to a thickness of 2.3 mm. The hot-rolled sheet was subjected to annealing in such a manner that it was held at 1100° C. for 30 sec and then at 900° C. for 30 sec and rapidly cooled. The cooled sheet was cold-rolled to a thickness of 0.22 mm, held at 810° to 850° C. for 90 sec to effect decarbonization annealing (annealing atmosphere $N_2$: 25%, $H_2$: 75%, D.P.=60° C.) and then held at 750° C. for 30 sec to effect annealing (annealing atmosphere $N_2$: 25%, $H_2$: 75%, D.P.<0° C.) while introducing $NH_3$ gas into the annealing furnace so that nitrogen could be absorbed into the steel sheet. In this case, the degree of nitriding (increase of nitrogen content) was 0.0081 to 0.0127% by weight. The average grain diameter of the steel sheet was measured under an optical microscope and with an image analyzer and found to be 21 to 29 μm (in terms of the diameter of circle with the same area as the grain has). The steel sheet was coated with an annealing separator composed mainly of MgO and subjected to final annealing in such a manner that it was heated to 1200° C. at a rate of 15° C./hr in an annealing atmosphere comprising 25% of $N_2$ and 75% of $H_2$ and held at 1200° C. for 20 hr in $H_2$. As is apparent from FIG. 1, a good magnetic density ($B_8/B_S \geqq 0.95$) ($B_S$: saturated magnetic density) was obtained in Al/Si≧0.0080.

Figure 2:
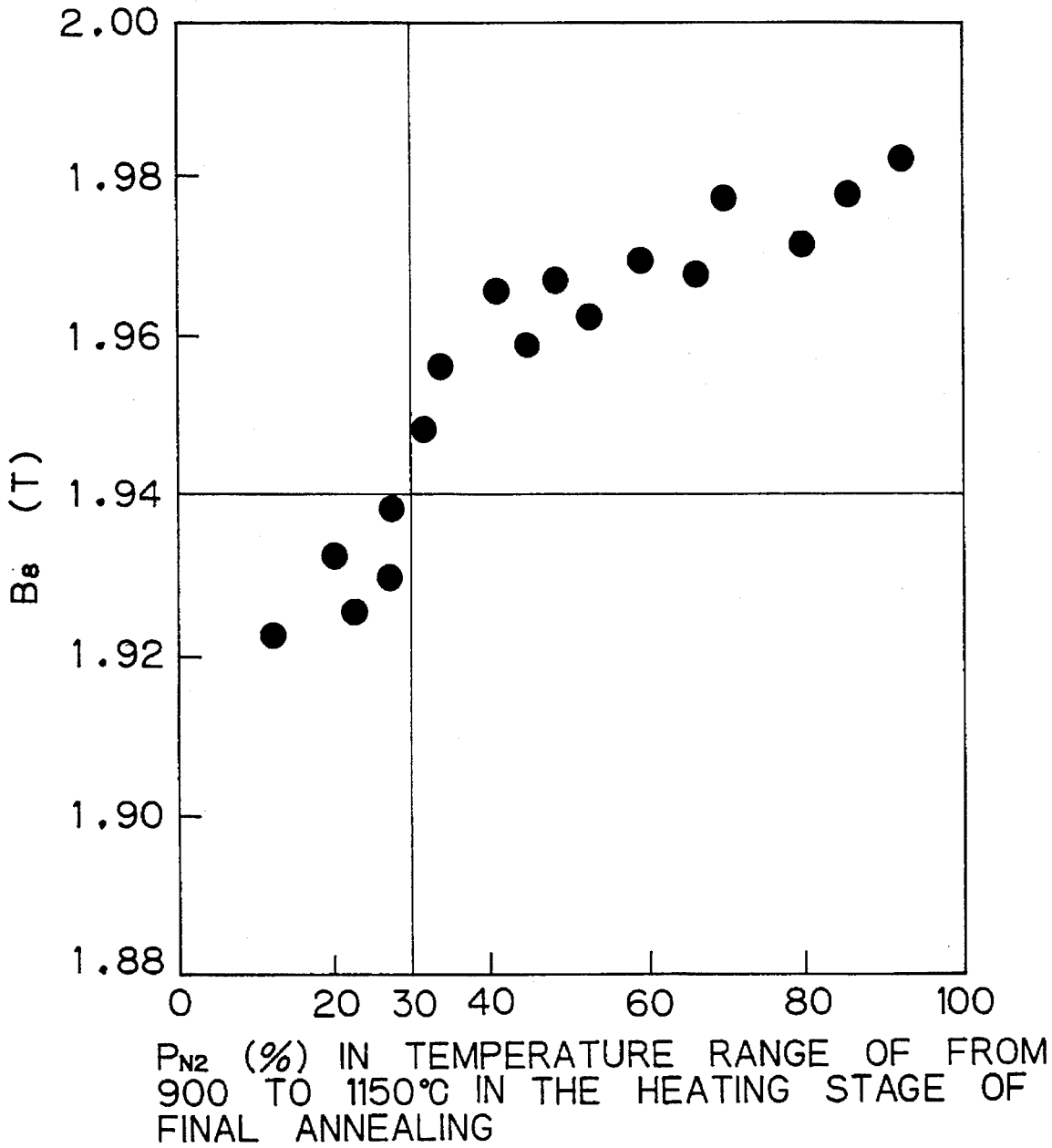
FIG. 2 is a graph showing the relationship between the partial pressure of nitrogen in the heating stage of the final annealing and the magnetic property.

The present inventors have made studies on means for further improving the magnetic property based on the results shown in FIG. 1. FIG. 2 is a graph showing the relationship between the partial pressure of nitrogen ($P_{N2}$ (%)) in annealing atmosphere at a temperature range of from 900° to 1150° C. in the heating stage of the final annealing and the magnetic property. In this case, a 40 mm-thick slab comprising 0.054% by weight of C, 3.51% by weight of Si, 0.034% by weight of acid sol. Al, 0.0086% by weight of N, 0.14% by weight of Mn and 0.007% by weight of S with the balance consisting of Fe and unavoidable impurities was subjected to a series of steps from hot rolling to nitriding under the same conditions as explained the case shown the results in FIG. 1. The nitrogen content was 0.0115% by weight, and the average grain diameter of the steel sheet after the nitriding was 23 μm (in terms of the diameter of a circle with the same area as the grain has). The steel sheet was coated with an annealing separator composed mainly of MgO and subjected to final annealing in such a manner that it was heated to 1200° C. at a rate of 15° C./hr and held at 1200° C. for 20 hr in $H_2$. In the final annealing, the steel sheet was treated in an annealing atmosphere comprising 25% of $N_2$ and 75% of $H_2$ until the temperature reached 900° C. in the heating stage, and then treated under conditions of various partial pressure ratios of $N_2$ to $H_2$ in a temperature range of from 900° to 1200° C. As is apparent from FIG. 2, a good magnetic density of $B_8 \geqq 1.94$ T was obtained when the $P_{N2}$ value (%) was 30% or more in a temperature range of from 900° to 1150° C.

The mechanism through which the effect of improving the magnetic flux density shown in FIGS. 1 and 2 can be attained has not been elucidated yet, but it is believed to be as follows. In the materials of the present invention, the main inhibitor for developing the secondary recrystallization is AlN, and it is considered that an increase in the Si content in the steel causes A1N to become unstable and (Al, Si)N and $Si_3N_4$ to become stable. As in the present invention, when the steel sheet is subjected to nitriding in a period between the completion of the hot rolling and the initiation of the secondary recrystallization in the final annealing, nitrogen concentrates in the vicinity of the surface of the steel sheet after nitriding and Si-base nitrides, such as $Si_3N_4$, precipitate in the portion where nitrogen concentrates. The nitrides, such as $Si_3N_4$, are decomposed during temperature elevation in the final annealing, so that the nitrogen content is homogenized over the whole thickness of the steel sheet and, at the same time, stable AlN precipitates. An increase in the Si content has an influence on such a change of the nitrides. Specifically, an increase in the Si content causes the Si-base nitrides, such as $Si_3N_4$, to be stabilized, so that the above-described homogenization of the nitrogen content and homogenization of the nitrides in the direction of the sheet thickness become difficult and, at the same time, it becomes difficult for the AlN to precipitate. When the secondary recrystallization is initiated in such a state that the precipitate is heterogeneous in the direction of the sheet thickness and the proportion of nitrides, such as $Si_3N_4$, is high, the secondary recrystallization proceeds with the inhibitor effect being low for the reasons including that ① Si-base nitrides, such as $Si_3N_4$, are liable to decompose at a high temperature and ② the amount of the nitrides is insufficient in the center portion of the sheet thickness. When the inhibitor effect is low, the special grain boundary characteristics of the grain boundary migration is so low that the secondary recrystallization becomes liable to occur also in oriented grains dispersed from Goss orientation wherein the Σ9 coincidence grain boundary density in the steel sheet is low. Consequently, the Goss integration density in the orientation of secondary recrystallized grains becomes low, which causes the magnetic flux to be lowered. Since this phenomenon is attributable to the influence of the Si content on the nitrides, it is considered that the problem of the regulation of the orientation of secondary recrystallized grains derived from an increase in the Si content could be solved by virtue of ① an action of an increase in the Al content with the increase in the Si content to stabilize AlN (see FIG. 1) and ② an action of an increase in the $P_{N2}$ in a secondary recrystallization temperature region during the temperature elevation in the final annealing to prevent the decomposition of the nitrides (see FIG. 2).

The present inventors have made extensive studies from various points of view on the regulation of the orientation of secondary recrystallized grains where the Si content is increased and, as a result, have found that it is necessary to regulate the annealing atmosphere depending upon the Si content. This will now be described in more detail with reference to the following experimental results.

Figure 3:
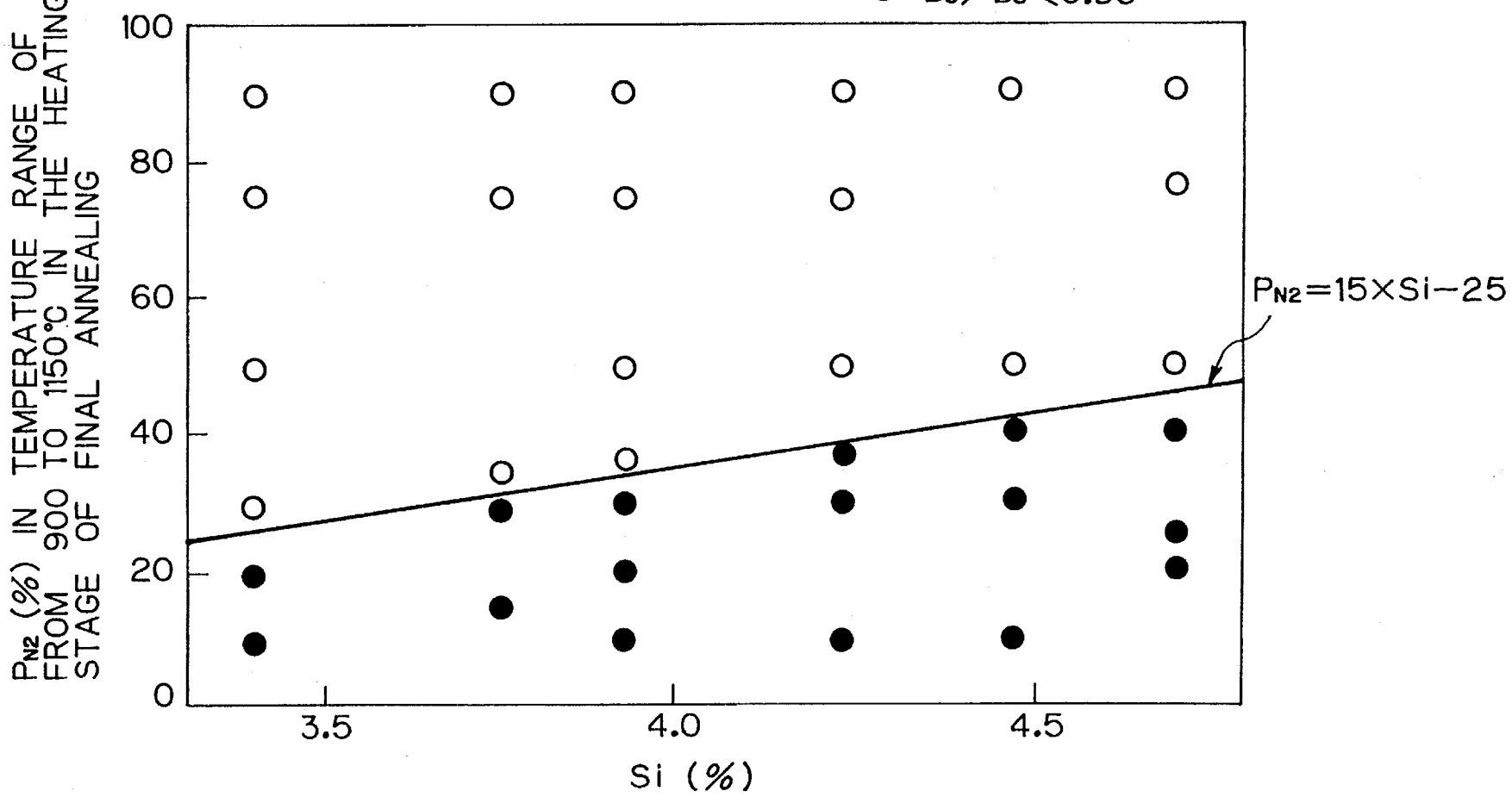
FIG. 3 is a graph showing the relationship between the partial pressure of nitrogen in the heating stage of the final annealing, the Si content and the magnetic property.

FIG. 3 is a graph showing the relationship between the Si content, the partial pressure of nitrogen ($P_{N2}$ (%)) in an annealing atmosphere in a temperature range of from 900° to 1150° C. in the heating stage of the final annealing and the magnetic property. In this case, a 40 mm-thick slab of a silicon steel comprising 0.055% by weight of C, 3.4 to 4.7% by weight of Si, 0.032% by weight of acid sol. Al, 0.0083% by weight of N, 0.13% by weight of Mn and 0.007% by weight of S with the balance consisting of Fe and unavoidable impurities was heated to 1150° C. for one hour and then hot-rolled to a thickness of 1.8 mm. The hot-rolled sheet was subjected to annealing in such a manner that it was held at 1100° C. for 30 sec and then at 900° C. for 30 sec and rapidly cooled. The cooled sheet was cold-rolled to a thickness of 0.170 mm, held at 835° C. for 90 sec to effect decarbonization annealing (annealing atmosphere $N_2$: 25%, $H_2$: 75%, D.P.=62° C.) and then held at 750° C. for 30 sec to effect annealing (annealing atmosphere $N_2$: 25%, $H_2$: 75%, D.P.<0° C.) while introducing $NH_3$ gas into the annealing furnace so that nitrogen could be absorbed into the steel sheet. In this case, the degree of nitriding (increase of nitrogen content) was 0.0128% by weight. The average grain diameter of the steel sheet after the nitriding treatment was 22 to 26 μm (in terms of the diameter of a circle with the same area as the grain has). The steel sheet was coated with an annealing separator composed mainly of MgO and subjected to final annealing in such a manner that it was heated to 1200° C. at a rate of 15° C./hr and held at 1200° C. for 20 hr in $H_2$. In the final annealing, the steel sheet was treated in an annealing atmosphere comprising 25% of $N_2$ and 75% of $H_2$ until the temperature reached 900° C. in the heating stage of the final annealing, and then treated under conditions of various partial pressure ratios of $N_2$ to $H_2$ in a temperature range of from 900° to 1200° C. As is apparent from FIG. 3, a good magnetic property of $B_8/B_S \geqq 0.95$ ($B_S$: saturated magnetic flux density) was obtained when the $P_{N2}$ value (%) was $P_{N2}$ value (%)$\geqq$15×Si (%)−25 in a temperature range of from 900° to 1200° C.

The mechanism through which the effect of improving the magnetic flux density shown in FIG. 3 can be attained has not been elucidated yet, it is believed to be as follows. In the materials of the present invention, the main inhibitor for developing the secondary recrystallization is AlN, and it is considered that an increase in the Si content in the steel causes AlN to become unstable and (Al, Si)N and $Si_3N_4$ to become stable. As in the present invention, when the steel sheet is subjected to nitriding in a period between the completion of the hot rolling and the initiation of the secondary recrystallization in the final annealing, nitrogen concentrates in the vicinity of the surface of the steel sheet after nitriding and Si-base nitrides, such as $Si_3N_4$, precipitates in the portion where nitrogen concentrates. The nitrides, such as $Si_3N_4$, are decomposed during temperature elevation in the final annealing, so that the nitrogen content is homogenized over the whole thickness of the steel sheet and, at the same time, stable AlN precipitates. An increase in the Si content has an influence on such a change of the nitrides. Specifically, an increase in the Si content causes the Si-base nitrides, such as $Si_3N_4$, to be stabilized, so that the above-described homogenization of the nitrogen content and homogenization of the nitrides in the direction of the sheet thickness become difficult and, at the same time, it becomes difficult for the AlN to precipitate. When the secondary recrystallization is initiated in such a state that the precipitate is heterogeneous in the direction of the sheet thickness and the proportion of nitrides, such as $Si_3N_4$, is high, the secondary recrystallization proceeds with the inhibitor effect being low for the reasons including that ① Si-base nitrides, such as $Si_3N_4$, are liable to decompose at a high temperature and ② the amount of the nitrides is insufficient in the center portion of the sheet thickness. When the inhibitor effect is low, the special grain boundary characteristics of the grain boundary migration is so low that the secondary recrystallization becomes liable to occur also in oriented grains dispersed from Goss orientation wherein the Σ9 coincidence grain boundary density in the steel sheet is low. Consequently, the Goss integration density in the orientation of secondary recrystallized grains becomes low, which causes the magnetic flux to be lowered. Since this phenomenon is attributable to the influence of the Si content on the nitrides, the tendency becomes significant with increasing the Si content. Therefore, it is considered that an increase in the partial pressure of nitrogen in an annealing atmosphere in the secondary recrystallization temperature region with the increase in the Si content to prevent the decomposition of the nitrides was effective for solving the problem of the regulation of the orientation of secondary recrystallized grains.

The reason for the limitation of the constituent features of the present invention will now be described.

At the outset, the reason for the limitation of the chemical compositions of the slab and the slab heating temperature will be described in detail.

The C content is limited to 0.025% by weight (hereinafter referred to simply as "%") or more because when it is less than 0.025% by weight, the secondary recrystallization becomes unstable and it becomes difficult to obtain a $B_8$ value exceeding 1.80 (T) even in the case of successful secondary recrystallization. Further, the C content should be 0.075% or less because when the C content is excessively high, the decarbonization annealing time should be prolonged, so that the profitability is lowered.

The Si content is limited to 5.0% or less because when it exceeds 5.0%, cracking becomes significant during cold rolling. Further, the Si content should be 2.5% or more because when it is less than 2.5%, the resistivity of the material is so low that no low iron 10ss necessary as an iron core material for transformers can be obtained. Especially, 3.4% or more of Si content is more desirable to obtain lower iron loss with use of the present invention.

The sol. Al content should be 0.015% or more for the purpose of ensuring AlN necessary for the stabilization of secondary recrystallization. When the acid sol. Al content exceeds 0.080%, the AlN precipitate situation of the hot-rolled sheet becomes improper, so that the secondary recrystallization becomes unstable. Accordingly, the acid sol. Al content should be 0.080% or less.

In order to obtain good magnetic properties, the Al (%)/Si (%) value should be 0.0080 or more. The Al (%)/Si (%) value was limited in this range because excellent magnetic properties could be obtained as shown in FIG. 1. Although the upper limit of the Al (%)/Si (%) value is not particularly limited, for example, it inevitably becomes 0.0235 from the upper limit of Al (%) and 3.4% of Si.

With respect to N, in the conventional steel making operation, it is difficult to reduce the N content to less than 0.0030%, and the reduction of the N content to less than 0.0030% is unfavorable from the viewpoint of the profitability. For this reason, the N content may be 0.0030% or more. However, when the N content exceeds 0.0130%, there occurs "bulging on the surface of the steel sheet" called "blistering". Therefore, the N content should be 0.0130% or less.

Even when MnS and MnSe are present in the steel, it is possible to improve the magnetic properties through proper selection of the conditions of the manufacturing steps. However, when the S and Se contents are high, there is a tendency for a poor secondary recrystallization called a banded fine grain to occur. In order to prevent the occurrence of the poor secondary recrystallization, it is desired for the content of (S+0.405 Se) to be 0.014% or less. When the S or Se content exceeds the above-described value, the probability of occurrence of the poor secondary recrystallization becomes unfavorably high no matter how the manufacturing conditions are controlled carefully. Further, in this case, the time necessary for purification in the final annealing becomes unfavorably too long. For this reason, unnecessary increase of the S or Se content makes no sense.

The lower limit of the Mn content is 0.05%. When the Mn content is less than 0.05%, the form (flatness) of a hot rolled sheet prepared by the hot rolling, especially the side end of the strip, becomes wavy, so that the yield of product unfavorably lowers. For this reason, the Mn content is limited to 0.05% or more. Further, a Mn content exceeding 0.8% is unfavorable because the magnetic flux density of products is lowered. Therefore, the upper limit of the Mn content is 0.8%.

The addition of Sn in an amount of 0.01 to 0.15% serves to enhance the inhibitor effect in the secondary recrystallization and hence is favorable for stably obtaining good magnetic properties. When the Sn content is less than 0.01%, this effect is unsatisfactory. On the other hand, when it exceeds 0.15%, the nitriding treatment unfavorably becomes difficult.

Cr serves to stabilize the formation of a film during the final annealing when it is added in combination with Sn. The amount of addition of Cr is properly in the range of from 0.03 to 0.20%, preferably in the range of from 0.05 to 0.15%.

Besides the above-described elements, Sb, Ti, Zr, Bi, Nb and other elements known as elements for constituting inhibitors may be added. Moreover, Cu and P may be added.

The production process according to the present invention will now be described.

An electrical steel slab is produced by preparing a steel in a melting furnace, such as a converter or an electric furnace according to a melting process, optionally subjecting the steel to a vacuum degassing treatment and subjecting the steel to continuous casting or blooming after ingot making.

The slab heating temperature is limited to below 1280° C. for the purpose of reducing the cost to a cost comparable with that of common steel. It is preferably 1200° C. or below.

The heated slab is subsequently hot-rolled to form a hot rolled sheet.

The hot-rolled sheet is optionally subjected to annealing and then subjected to cold rolling once or more times including final cold rolling with a reduction ratio of 80% or more (optionally with an intermediate annealing being effected between the cold rollings). The reduction ratio in the final cold rolling is limited to 80% or more because, in this reduction ratio range, it is possible to obtain proper amounts of grains having a sharp {110}<001> orientation and coincidence oriented grains (such as grains having a {111}<112> orientation) in relation to {110}<001> orientation in the steel sheet subjected to decarbonization annealing which contributes to an improvement in the magnetic flux density.

Thus, a material having a thin gage in the range of from 0.25 to 0.10 mm can be produced.

When cold rolling is effected once or more times with an intermediate annealing being effected between cold rollings, a rolled sheet having a good shape and secondary-recrystallized grains having an excellent orientation can be provided when the first cold rolling, that is, preliminary cold rolling, is effected with a reduction ratio in the range of from 10 to 50%, preferably in the range of from 10 to 35%.

The above-described preliminary cold rolling will now be described in more detail based on experimental data.

An ingot comprising chemical compositions specified in Table 1 was heated to 1150° C. and hot-rolled into a sheet having a thickness of 1.8 mm and a sheet having a thickness of 2.1 mm.

TABLE 1

| (wt. %) | | | | | | | |
|---|---|---|---|---|---|---|---|
| C | Si | Mn | S | sol. Al | N | Cr | Sn |
| 0.054 | 3.3 | 0.14 | 0.007 | 0.030 | 0.0075 | 0.12 | 0.05 |

Then, the sheets were subjected to preliminary cold rolling as shown in Table 2, annealed at 1100° C. and 900° C., rapidly cooled, pickled and subjected to final cold rolling as shown in Table 2.

The sheets under the above-described cold rolling conditions were subjected to decarbonization annealing at 830° C. for 70 sec in a humid hydrogen/nitrogen gas and nitrided at 750° C. for 30 sec in an atmosphere of a mixed gas comprising hydrogen, nitrogen and ammonia. In all the samples, the average diameter of primary recrystallized grains after nitriding was in the range of from 23 to 24 μm, and the nitrogen content after nitriding was about 220 ppm. Thereafter, the steel sheets were coated with an annealing separator and then subjected to final annealing at 1200° C. for 20 hr.

Figure 4:
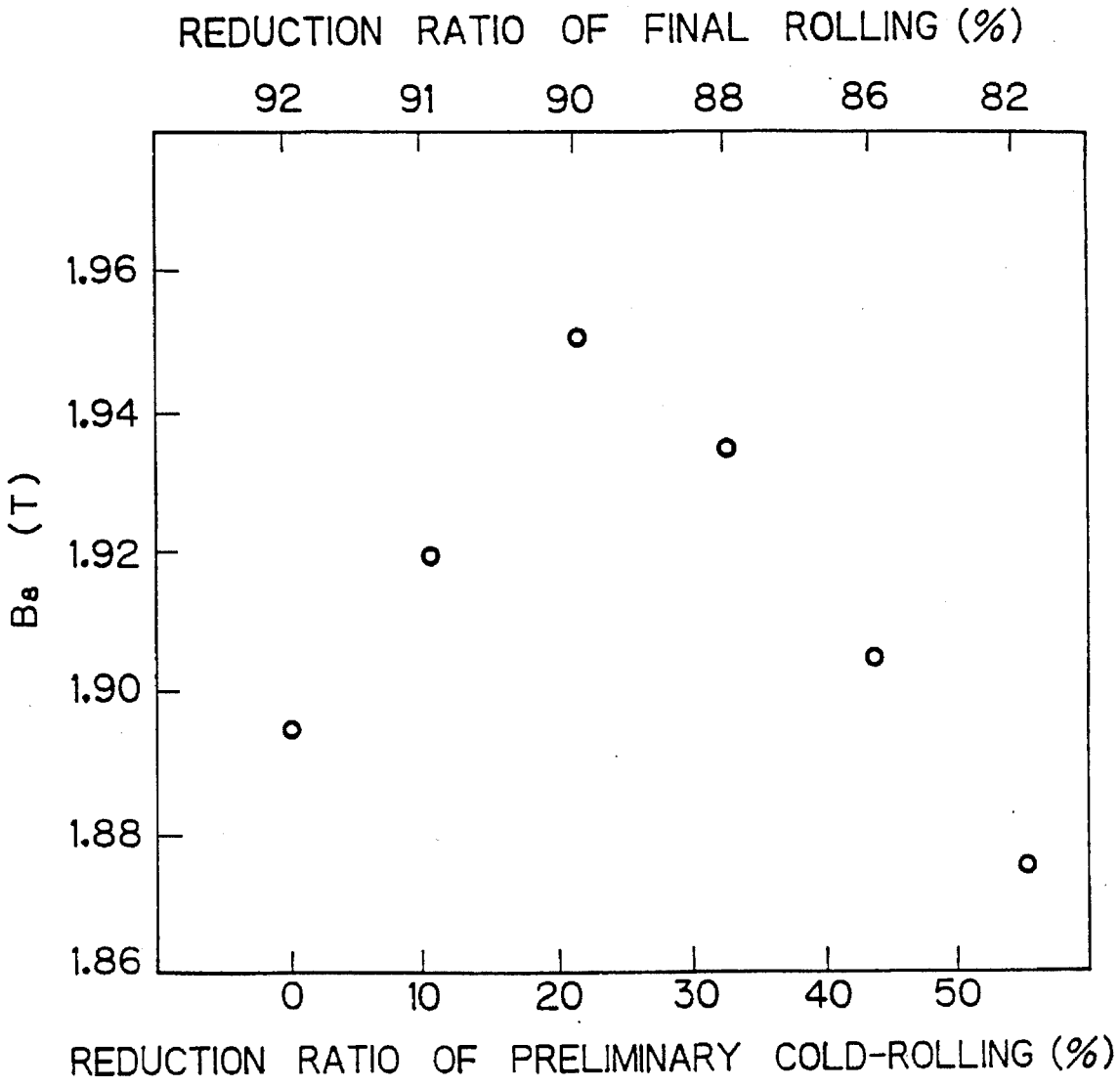
FIG. 4 is a diagram showing the relationship between the reduction ratio of preliminary rolling (final rolling) and the magnetic flux density ($B_8$) (thickness of hot rolled sheet: 1.8 mm)
Figure 5:
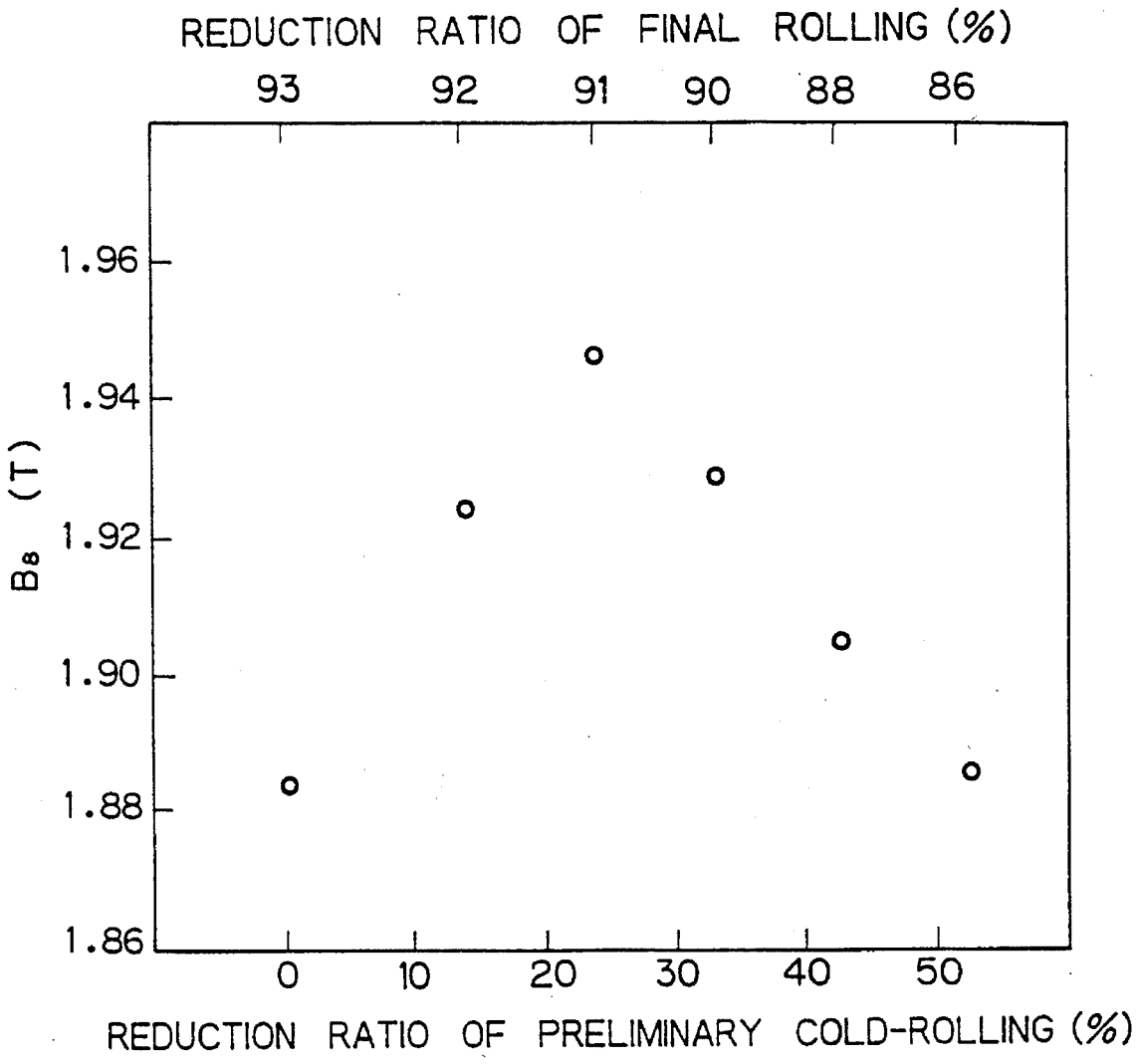
FIG. 5 is a diagram showing the relationship between the reduction ratio of preliminary rolling (final rolling) and the magnetic flux density ($B_8$) (thickness of hot rolled sheet: 2.1 mm).

The results are given in FIGS. 4 and 5. As is apparent from these drawings, the magnetic property greatly varies depending upon the reduction ratio of the cold rolling.

TABLE 2

| Thickness of Hot-Rolled Sheet (mm) | Thickness of Preliminary Cold-Rolled Sheet (mm) | (Reduction ratio in Preliminary Cold-Rolling (%)) | Thickness of Final Cold-Rolled Sheet (mm) | (Production ratio in Final Cold Rolling (%)) |
|---|---|---|---|---|
| 1.8 | 1.8 | 0 | 0.14 | 92 |
| 1.8 | 1.6 | 11 | 0.14 | 91 |

TABLE 2-continued

| Thickness of Hot-Rolled Sheet (mm) | Thickness of Preliminary Cold-Rolled Sheet (mm) | (Reduction ratio in Preliminary Cold-Rolling (%)) | Thickness of Final Cold-Rolled Sheet (mm) | (Production ratio in Final Cold Rolling (%)) |
|---|---|---|---|---|
| 1.8 | 1.4 | 22 | 0.14 | 90 |
| 1.8 | 1.2 | 33 | 0.14 | 88 |
| 1.8 | 1.0 | 44 | 0.14 | 86 |
| 1.8 | 0.8 | 55 | 0.14 | 82 |
| 2.1 | 2.1 | 0 | 0.14 | 93 |
| 2.1 | 1.8 | 14 | 0.14 | 92 |
| 2.1 | 1.6 | 24 | 0.14 | 91 |
| 2.1 | 1.4 | 33 | 0.14 | 90 |
| 2.1 | 1.2 | 43 | 0.14 | 88 |
| 2.1 | 1.0 | 52 | 0.14 | 86 |

Hot-rolled sheets having varied thickness were preliminary cold- rolled with various reduction ratios, annealed, cold-rolled to a thickness of 0.12 mm and subjected to the same treatment as that described above. The results are given in Table 3.

The thicknesses of the hot-rolled sheets were 2.4 mm, 2.0 mm and 1.6 mm, and the chemical composition and treatment conditions were the same as those used in the above-described experiment. As is apparent from the results, reduction ratio in preliminary cold-rolling of 31% and 45% provided a high $B_8$ value, and a reduction ratio in preliminary cold-rolling of 54% provided a low $B_8$ value.

As is apparent from the above results, although the magnetic flux density greatly varies depending upon the reduction ratio in the cold rolling, a high magnetic flux density is obtained when the reduction ratio in the preliminary cold-rolling is in the range of from 10 to 50%, preferably in the range of from 10 to 35%.

TABLE 3

| | | | |
|---|---|---|---|
| Reduction Ratio in Preliminary Cold-Rolling (%) | 31 | 45 | 54 |
| $B_8$ (T) | 1.95 | 1.93 | 1.88 |

It is known that secondary recrystallized grains of the grain oriented electrical steel sheet grow in such a manner that Goss nuclei formed on the surface layer of the steel sheet encroach on the center layer and pass through the sheet thickness.

In general, it is known from experience that, in order to provide secondary recrystallized grains having an excellent orientation, it is preferred for the reduction ratio in the final rolling to be in a proper range and, at the same time, for the texture in the surface layer after decarbonization annealing to be different from that in the center layer. In FIGS. 4 and 5 and Table 3, it is considered that, when the reduction ratio in the preliminary cold-rolling is low, the reduction ratio in the final rolling becomes so high that the Goss nuclei in the texture of the primary recrystallized sheet are reduced, while when the reduction ratio in the preliminary cold-rolling is high, since the recrystallization of the steel sheet proceeds before the final cold rolling, the difference in the texture in the direction of the thickness in the sheet after decarbonization annealing becomes so small that it becomes difficult to provide secondary recrystallized grains having an excellent orientation. Thus, the optimization of the reduction ratio in the preliminary cold-rolling and the reduction ratio in the final cold rolling enables products with the excellent magnetic properties having a thin gage to be provided.

As described above, when the preliminary cold-rolling is adopted, a heated electrical steel slab is hot-rolled, pickled, preliminary cold-rolled with a reduction ratio of 10 to 50%, annealed at a temperature in the range of from 900° to 1200° C. for at least 30 sec and subjected to cold rolling including final cold rolling with a reduction ratio of 80% or more to provide a thin steel sheet having a thickness of 0.10 to 0.25 mm.

The steel sheet as cold-rolled is then subjected to a series of treatments, that is, decarbonization annealing, coating with an annealing separator and final annealing to provide a final product.

In this connection, in order to provide good magnetic properties, it is necessary to regulate the average grain diameter of primary recrystallized grains to 18 to 35 μm in a period between the completion of the decarbonization annealing and the initiation of the final annealing. When the average grain diameter is less than 18 μm, the regulation of the orientation of secondary recrystallized grains becomes difficult, while when it exceeds 35 μM, the secondary recrystallization unfavorably becomes unstable.

In the present invention, the steel sheet is subjected to a nitriding treatment in a period between the completion of the hot rolling and the initiation of the secondary recrystallization in the final annealing. This is because the inhibitor effect necessary for the secondary recrystallization is liable to become insufficient in processes on the premise that the slab is heated at a low temperature as in the present invention.

More specifically, the slab is heated at a low temperature of 1200° C. or below. Therefore, Al, Mn and S, etc., in the steel are in an incomplete solid solution form, and in this state, the amount of inhibitors, such as AlN and (Al, Si)N, necessary for developing the secondary recrystallization in the steel is insufficient. For this reason, prior to the development of the secondary recrystallization, it is necessary to infiltrate N into the steel to form an inhibitor. The nitrogen content should be 10 ppm or more.

There is no particular limitation on the nitriding method, and the nitriding may be effected by any of a method wherein, subsequent to the decarbonization annealing, $NH_3$ gas is introduced into the annealing atmosphere to effect nitriding, a method wherein use is made of plasma, a method wherein a nitride is incorporated in the annealing separator and the nitride is decomposed, during temperature elevation in the final annealing, into nitrogen which is absorbed into the steel sheet, and a method wherein the partial pressure of nitrogen in an atmosphere in the final annealing is enhanced to nitride the steel sheet.

In order to provide excellent magnetic properties, the best method among the above-described methods is to increase the partial pressure of nitrogen in the annealing atmosphere to at least 12.5% or more, more preferably, 30% or more in a steel sheet temperature range of from 900° to 1150° C. in the heating stage of the final annealing. With respect to the annealing atmosphere at a temperature below 900° C., there is no need to specify the partial pressure of nitrogen. Since the secondary recrystallization usually occurs at a temperature in the range of from 900° to 1150° C., the regulation of the annealing atmosphere in this temperature range suffices for providing good magnetic properties.

In final annealing of the grain oriented electrical steel sheet, the atmosphere gas usually comprises $N_2$, $H_2$ or a mixed gas comprising $N_2$ and $H_2$. According to the present invention, in the heating stage, it is also important to stabilize the inhibitor in the glass film decomposition process. For this reason, it is preferred to use a mixed gas comprising 30% or more of $N_2$, $H_2$ and other inert gases as an atmosphere during the temperature elevation. When the amount of $N_2$ is less than 30%, the capability of preventing the inhibitor effect of (Al, Si)N during the glass film decomposition process from lowering is so low that a material having a high magnetic flux density cannot be stably obtained. In particular, in an atmosphere having a $N_2$ content of 20% or less, the deterioration in the magnetism is significant.

On the other hand, if the atmosphere gas comprises 100% of $N_2$, the steel sheet becomes very oxidizable depending upon property values of MgO, so that the surface of the steel sheet is oxidized, which often causes the quality to become uneven. The $N_2$ content is preferably in the range of from 30 to 90%. Although the $N_2$ gas content may be increased to 30% or more over the whole period of the temperature elevation, it is particularly preferred for the $N_2$ gas content to be increased to 30% or more in a period between after the temperature exceeds 900° C. and when the temperature reaches the soaking temperature.

As described above, as can be seen from FIG. 3, it is more important to regulate the partial pressure of nitrogen, $P_{N2}$ (%), in an annealing atmosphere so as to satisfy the requirement for the relationship between the partial pressure of nitrogen and the Si content, that is, a requirement represented by the formula $P_{N2}$ (%)$\geqq$15×Si (%)−25, in a steel sheet temperature range of from 900° to 1150° C. in the heating stage of the final annealing for the purpose of providing excellent magnetic properties.

In the final annealing, the temperature is usually raised to 1100° to 1250° C., preferably 1180° to 1250° C. The secondary recrystallization is usually completed during the temperature elevation, and the steel sheet is then maintained at a constant temperature for purification. The step of holding the steel sheet at a constant temperature subsequent to the temperature elevation is usually effected for 5 to 50 hr. This operation is usually effected in an annealing atmosphere composed of $H_2$ gas alone or composed mainly of $H_2$ gas. When the steel sheet is held at a constant temperature, for example, in the range of from 1000° to 1100° C., further heated and then held at a constant temperature for purification, the temperature range before purification is regarded as the heating stage (the step of temperature elevation). The upper limit of $P_{N2}$ value in the temperature elevation in the temperature range of from 900° to 1150° C. is not particularly limited, and a $P_{N2}$ value up to 100% is acceptable.

The smoothing of the surface of the steel sheet which is one of the characteristic features of the present invention will now be described. The surface smoothing technique consists in an improvement in the annealing separator for coating the steel sheet subjected to decarbonization annealing for the purpose of effecting final annealing of the steel sheet. For this purpose, the following two groups of annealing separators may be provided.

(1) An annealing separator comprising 100 parts by weight of MgO and, added thereto, 2 to 30 parts by weight in total of at least one member selected from the group consisting of chlorides, carbonates, nitrates, sulfides and sulfates of Li, K, Na, Ba, Ca, Mg, Zn, Fe, Zr, Sr, Sn and Al. When the amount of the additive is less than 2 parts by weight, it is difficult to provide a product having no or almost no glass film at all over the whole surface of the coil. On the other hand, when the amount of the additive exceeds 30 parts by weight, the constituent element of the additive is diffused and infiltrated into the steel to unfavorably affect the inhibitor, gives rise to grain boundary etching or affects subsequent purification.

(2) An oxide present on the surface of the steel sheet, for example, a material less reactive with silica, is used as the annealing separator. Although the oxide for this purpose is preferably $Al_2O_3$ from the viewpoint of cost, it is also possible to use other oxides such as $SiO_2$, $ZrO_2$, BaO, CaO and SrO. Further, the annealing separator may comprise $Al_2O_3$ as a main component and, added thereto, 5 to 30% of $TiO_2$. In order to lower the oxygen potential during the final annealing, it is important to prevent water from being carried when use is made of the above-described annealing separator. Electrostatic coating of the above-described material in a powder form is useful for this purpose.

In the case of using annealing separator of group (1), the sheet subjected to decarbonization annealing and coated with the above-described annealing separator is subjected to final annealing. In the early stage of the temperature elevation in the final annealing, the melting point of the MgO and oxide film is lowered to form a forsterite film having a suitable small thickness.

Then, the growth and additional oxidation of the forsterite are prevented, and in the latter stage, the film layer is decomposed by an etching reaction of Fe caused in the film and boundary between Fe and the film, so that a surface free or almost free from glass film can be obtained. Selection of proper final annealing conditions is particularly important to a process involving the above-described suitable glass film formation and decomposition as in the present invention.

As described above, in the present invention, the soaking temperature in the final annealing is preferably in the range of from 1180° to 1250° C. When the temperature has reached the soaking temperate in the final annealing, the decomposition of the glass film is in a completed state. In this stage, the soaking in the above-described temperature range further gives rise to thermal etching to render the surface of the steel sheet specular. This contributes to a further increase in the effect of improving the iron loss.

A soaking temperature below 1180° C. provides only a small effect and is disadvantageous for the purification of the steel sheet. On the other hand, when the soaking temperature exceeds 1250° C., the effect of providing a specular surface is saturated. Further, in this case, the shape of the coil is unsatisfactory. After the completion of the secondary recrystallization, the steel sheet is annealed in an atmosphere comprising 100% of hydrogen at a temperature of 1100° C. or above for the purpose of effecting the purification of nitrides and smoothing the surface of the steel sheet.

In the case of using annealing separator of either group (1) or (2), the removal of the oxide present on the surface of the steel sheet prior to the coating of the annealing separator on the steel sheet subjected to the decarbonization annealing is useful for smoothing the surface of the steel sheet product.

After the completion of the finish annealing, the steel sheet is coated with an insulating film forming agent and subjected to heat flattening. In this connection, it is preferred to impart a dotted or linear flaw to the surface of the steel sheet by local working by means of a laser beam, a sprocket roll, or a press, and marking and local etching before or after the heat flattening treatment for the purpose of lowering the iron loss. When the steel sheet is worked into an iron core and used without stress relief annealing by users, the depth of (stacked) flaw may be as small as 5 μm or less.

On the other hand, when stress relief annealing is effected (in the case of a wound core), a deep potted or linear flaw, for example, a flaw having a depth of 5 to 50 μm, is imparted. The flaw is imparted at intervals of 2 to 15 mm and at an angle of 45° to 90° to the direction of rolling. When the steel sheet is used without stress relief annealing, it is important to impart a suitable strain to the surface of the steel sheet. Although the degree of the strain cannot be particularly specified by the depth of the flaw, when the treatment is effected with a laser beam or the like, a flaw having a depth of 1 to 5 μm can provide a suitable strain.

In the case of wound cores which are subjected to stress relief annealing, when the depth of the flaw is in the range of from 5 to 50 μm, the lowering in the magnetic flux density is small and the effect of improving the iron loss is large. The width of the flaw is preferably 200 μm or less.

Conditions for treatment with an insulating film forming agent are also important to the present invention. In grain oriented electrical steel sheets provided with a glass film, when an insulating film forming agent for imparting a tension to the sheet is coated and baked, it is coated at a coverage of 3 to 5 g/m$^2$. This is because even though the insulating film forming agent is coated at a coverage exceeding the above-described range, there is a limitation on the effect of improving the iron loss due to problems of the influence of internal oxidation in the thick film and the increase in the weight of the film. Further, in this case, the magnetism deteriorates due to the lowering in the space factor.

On the other hand, since the products according to the present invention are substantially free from or without the glass film, the insulating film forming agent for imparting tension is coated at a coverage in the range of 2.5 to 15 g/m$^2$, and when the sheet thickness is 0.30 mm, it is coated at a coverage in the range of from 6 to 15 g/m$^2$. When it is applied to a material having a smaller thickness, the coverage may be reduced depending upon the sheet thickness.

This is because the improvement in the iron loss can be attained even in the case of a large coverage by virtue of the freedom from the problem of the internal coating layer of the glass film and a high smoothness of the matrix surface of the steel sheet. In particular, when the above-described the magnetic domain control has been effected, the application of this treatment for imparting tension enables the iron loss to be lowered to a great extent. In the case where a steel sheet thickness is 0.3 mm, when the coverage of the insulating film forming agent is 5 g/mm$^2$ or less, it is impossible to provide a tension of 0.5 kg/mm$^2$. On the other hand, when the coverage is 15 g/m$^2$ or more, an unfavorable adverse effect of the weight and thickness of the film occurs.

Examples of the insulating film forming agent include one comprising 100 parts by weight (on a solid basis) of a colloidal solution of $SiO_2$, $SnO_2$ or $Al_2O_3$, 130 to 200 parts by weight of a monobasic phosphate, such as Al, Mg or Ca, and 12 to 40 parts by weight of chromic acid or chromate as $CrO_3$.

When the mixing ratio of the colloidal substance to the phosphate is outside the above-described range, the effect of tension cannot be attained, so that the mixing ratio outside the above-described range is unsuitable for the present invention. A particularly excellent film property can be provided when use is made of an insulating film forming agent composed mainly of a sol of $SiO_2$ or $SnO_2$. Although the chromic acid and chromate are substantially independent of the effect of tension, they have the effect of inhibiting the development of the hygroscopic property of the film. When the amount of addition thereof is 12 parts by weight or less, the effect of inhibiting the hygroscopic property is small. On the other hand, when the amount of addition thereof exceeds 40 parts by weight or more, the hygroscopic property develops due to the presence of excess chromium or the appearance of the steel sheet deteriorates.

The heat flattening is preferably effected in an atmosphere capable of satisfying a requirement of $PH_2O/PH_2 \leqq 0.1$ and $H_2 \geqq 5\%$ in a temperature region of 600° C. or above. This limitation is provided for the purpose of maintaining good magnetism and adhesion between the surface of the steel and the film because, when steel sheets substantially free from or without a glass film as in the present invention is subjected to heat flatting at a high temperature, oxidation is liable to occur in the furnace.

The grain oriented electrical steel sheet substantially free from or without a glass film and having a high magnetic flux density thus produced has a very low iron loss by virtue of the magnetic domain control and the provision of tension by the insulting film. This is because, as opposed to the conventional glass film materials, there is no adverse effect of the internal film layer by virtue of the smooth surface of the steel sheet.

When an insulating film material for imparting tension is applied to the materials according to the present invention, the effect of improving the iron loss can be attained even when the coverage is considerably large.

As described above, according to the present invention, in high-Si materials having a Si content of 3.4 to 5.0% and materials having a small thickness of 0.14 mm, 0.12 mm or the like, it is possible to provide grain oriented electrical steel sheets having a high magnetic flux density. Further, the provision of the step of smoothing the surface of the steel sheet enables grain oriented electrical steel sheets having a very good iron loss property to be produced.

EXAMPLES

The present invention will now be described in more detail with reference to the following Examples.

Examples 1

Three types of 40 mm-thick slabs comprising 0.056% by weight of C, 3.58% by weight of Si, 0.14% by weight of Mn, 0.005% by weight of S, acid sol. Al in an amount of ① 0.020% by weight, ② 0.031% by weight or ③ 0.036% by weight and 0.0078% by weight of N with the balance consisting of Fe and unavoidable impurities were heated to 1150° C., and hot rolling was initiated at 1050° C. and conducted for 6 passes to form hot rolled sheets having a thickness of 2.3 mm.

The hot-rolled sheets were subjected to annealing in such a manner that they were held at 1120° C. for 30 sec, held at 900° C. for 30 sec and then rapidly cooled. Thereafter, the steel sheets were cold-rolled with a reduction ratio of about 90.4% to provide cold-rolled sheets having a thickness of 0.22 mm which were then held at 830° C. for 90 sec to effect decarbonization annealing. Then, they were annealed by holding them at a temperature of 750° C. for 30 sec while introducing $NH_3$ gas into the annealing atmosphere to nitride the steel sheets. In this case, the degree of nitriding (increase in the nitrogen content) was 0.0110 to 0.0132% by weight, and the average grain diameter of the steel sheets after the nitriding was 22 to 25 μm (in terms of the diameter of a circle with the same area as the grain has). The steel sheets after nitriding were coated with an annealing separator composed mainly of MgO and subjected to final annealing in such a manner that they were heated to 1200° C. at a rate of 15° C./hr and held at 1200° C. for 20 hr in $H_2$. In the final annealing, the steel sheets were treated in an annealing atmosphere comprising 25% of $N_2$ and 75% of $H_2$ until the temperature reached 900° C. in the heating stage, and then treated under conditions on four levels, that is, (a) $N_2$: 15%, $H_2$: 85%, (b) $N_2$: 25%, $H_2$: 75%, (c) $N_2$: 50%, $H_2$: 50%, (d) $N_2$: 90%, $H_2$: 10%, in a temperature range of from 900° to 1200° C.

The relationship between the process conditions and the magnetic property is given in Table 4. As is apparent from Table 4, sample Nos. 5, 6, 9 and 10 satisfying requirements specified in the present invention had a good magnetic property of $B_8 \geqq 1.92$ T. Further, samples 7, 8, 11 and 12 according to the present invention had a better magnetic property of $B_8 \geqq 1.94$ T.

TABLE 4

| Material No. | Chemical composition | Al (%)/ Si (%) | Atmosphere Conditions for Final Annealing | $B_8$ (T) | Remarks |
|---|---|---|---|---|---|
| 1 | ① | 0.0056 | (a) | 1.89 | Comp. Ex. |
| 2 | ① | 0.0056 | (b) | 1.88 | Comp. Ex. |
| 3 | ① | 0.0056 | (c) | 1.90 | Comp. Ex. |
| 4 | ① | 0.0056 | (d) | 1.90 | Comp. Ex. |
| 5 | ② | 0.0087 | (a) | 1.92 | invention |
| 6 | ② | 0.0087 | (b) | 1.93 | Invention |
| 7 | ② | 0.0087 | (c) | 1.95 | Invention |
| 8 | ② | 0.0087 | (d) | 1.95 | Invention |
| 9 | ③ | 0.0101 | (a) | 1.92 | Invention |
| 10 | ③ | 0.0101 | (b) | 1.93 | Invention |
| 11 | ③ | 0.0101 | (c) | 1.94 | Invention |
| 12 | ③ | 0.0101 | (d) | 1.96 | Invention |

Example 2

Two types of 40 mm-thick slabs comprising 0.058% by weight of C, 3.51% by weight of Si, 0.14% by weight of Mn, 0.006% by weight of S, acid sol. Al in an amount of ① 0.021% by weight or ② 0.034% by weight and 0.0082% by weight of N and 0.05% by weight of Sn with the balance consisting of Fe and unavoidable impurities were heated at 1150° C. and hot-rolled to form hot-rolled sheets having a thickness of 2.3 mm.

The hot-rolled sheets were subjected to annealing in such a manner that they were held at 1120° C. for 30 sec, held at 900° C. for 30 sec and then rapidly cooled. Thereafter, the steel sheets were cold-rolled with a reduction ratio of about 90.4% to provide cold-rolled sheets having a thickness of 0.22 mm which were then held at 835° C. for 90 sec to effect decarbonization annealing. Then, they were annealed by holding them at a temperature of 750° C. for 30 sec while introducing $NH_3$ gas into the annealing atmosphere to nitride the steel sheets. In this case, the degree of nitriding (increase in the nitrogen content) was 0.0114 to 0.0121% by weight, and the average grain diameter of the steel sheets after the nitriding was 23 to 24 μm (in terms of the diameter of a circle with the same area as the grain has). The steel sheets after nitriding were coated with an annealing separator composed mainly of MgO and subjected to final annealing in such a manner that they were heated to 1200° C. at a rate of 10° C./hr and held at 1200° C. for 20 hr in $H_2$. In the final annealing, the steel sheets were treated in an annealing atmosphere comprising 15% of $N_2$ and 85% of $H_2$ until the temperature reached 850° C. in the heating stage, and then treated under conditions on two levels, that is, (a) $N_2$: 15%, $H_2$: 85% and (b) $N_2$: 90%, $H_2$: 10%, in a temperature range of from 850° to 1200° C.

The relationship between the process conditions and the magnetic property is given in Table 5. As is apparent from Table 5, sample No. 15 according to the present invention had a good magnetic property of $B_8$=1.93 T. Further, sample No. 16 according to the present invention had a better magnetic property of $B_8$=1.95 T.

TABLE 5

| Material No. | Chemical composition | Al (%)/ Si (%) | Atmosphere Conditions for Final Annealing | $B_8$ (T) | Remarks |
|---|---|---|---|---|---|
| 13 | ① | 0.0060 | (a) | 1.89 | Comp. Ex. |
| 14 | ① | 0.0060 | (b) | 1.91 | Comp. Ex. |
| 15 | ② | 0.0088 | (a) | 1.93 | Invention |
| 16 | ② | 0.0088 | (b) | 1.95 | Invention |

Example 3

Three types of 40 mm-thick slabs comprising 0.060% by weight of C, 4.01% by weight of Si, 0.14% by weight of Mm, 0.007% by weight of S, 0.039% by weight of acid sol. Al, 0.0086% by weight of N and Sn in an amount of ① 0.003% by weight, ② 0.07% by weight and ③ 0.20% by weight with the balance consisting of Fe and unavoidable impurities were heated at 1150° C. and hot-rolled to form hot-rolled sheets having a thickness of 2.3 mm. In this case, Al (%)/Si (%) was 0.0097.

The hot-rolled sheets were subjected to annealing in such a manner that they were held at 1100° C. for 30 sec, held at 900° C. for 30 sec and then rapidly cooled. Thereafter, the steel sheets were cold-rolled with a reduction ratio of about 90.4% to provide cold-rolled sheets having a thickness of 0.22 mm which were then held at 830° C. for 90 sec to effect decarbonization annealing. Then, they were annealed by holding them at a temperature of 750° C. for 30 sec while introducing $NH_3$ gas into the annealing atmosphere to nitride the steel sheets. In this case, the degree of nitriding (increase in the nitrogen content) was 0.0078 to 0.0129% by weight, and the average grain diameter of the steel sheets after the nitriding was 21 to 26 μm (in terms of the diameter of a circle with the same area as the grain has). The steel sheets after nitriding were coated with an annealing separator composed mainly of MgO and subjected to final annealing in such a manner that they were heated to 1200° C. at a rate of 15° C./hr in an annealing atmosphere comprising 25% of $N_2$ and 75% of $H_2$ and held at 1200° C. for 20 hr in $H_2$.

The relationship between the process conditions and the magnetic property is given in Table 6. All the conditions for the present experiment satisfy the requirements specified in the present invention, and all the samples had a good magnetic property of $B_8 \geqq 1.92$ T. Further, sample NO. 18 having a Sn content falling within the scope of the present invention had a better magnetic property of $B_8$=1.95 T.

TABLE 6

| Sample No. | Sn | $B_8$ (T) | Remarks |
|---|---|---|---|
| 17 | ① | 1.92 | Invention |
| 18 | ② | 1.95 | Invention |
| 19 | ③ | 1.92 | Invention |

Example 4

A 40 mm-thick slab comprising 0.059% by weight of C, 3.75% by weight of Si, 0.14% by weight of Mn, 0.005% by weight of S, 0.039% by weight of acid sol. Al, 0.0088% by weight of N and 0.06% by weight of Sn with the balance consisting of Fe and unavoidable impurities was heated at 1150° C. and hot-rolled to form a hot-rolled sheet having a thickness of 1.8 mm. In this case, Al (%)/Si (%) was 0.0104.

The hot-rolled sheet was subjected to cold-rolling to a thickness of 1.4 mm and then to annealing in such a manner that it was held at 1120° C. for 30 sec, held at 900° C. for 30 sec and then rapidly cooled. Thereafter, the steel sheet was cold-rolled with a reduction ratio of about 89.6% to provide a cold-rolled sheet having a thickness of 0.145 mm which was then held at 830° C. for 70 sec to effect decarbonization annealing. Then, it was annealed by holding it at a temperature of 750° C. for 30 sec while introducing $NH_3$ gas into the annealing atmosphere to nitride the steel sheet. In this case, the degree of nitriding (increase in the nitrogen content) was 0.0141 to 0.0152% by weight, and the average grain diameter of the steel sheet after the nitriding was 23 to 25 μm (in terms of the diameter of a circle with the same area as the grain has). The steel sheet after nitriding was coated with an annealing separator composed mainly of MgO and subjected to final annealing in such a manner that it was heated to 1200° C. at a rate of 15° C./hr and held at 1200° C. for 20 hr in $H_2$. In the final annealing, the steel sheet was treated in an annealing atmosphere comprising 25% of $N_2$ and 75% of $H_2$ until the temperature reached 900° C. in the heating stage, and then treated under conditions on three levels, that is, (a) $N_2$: 25%, $H_2$: 75%, (b) $N_2$: 75%, $H_2$: 25% and (c) $N_2$: 90%, $H_2$: 10%, in a temperature range of from 900° to 1200° C. The relationship between the process conditions and the magnetic property is given in Table 7. All the conditions for the present experiment satisfy the requirements specified in the present invention, and all the samples had a good magnetic property of $B_8 \geqq 1.92$ T. Further, sample Nos. 21 and 22 satisfying the final annealing requirement specified in the present invention had a better magnetic property of $B_8 \geqq 1.94$ T.

TABLE 7

| Sample No. | Atmosphere Conditions for Final Annealing | $B_8$ (T) | Remarks |
|---|---|---|---|
| 20 | (a) | 1.92 | Invention |
| 21 | (b) | 1.94 | Invention |
| 22 | (c) | 1.95 | Invention |

Example 5

Three types of 40 mm-thick slabs comprising 0.060% by weight of C, 4.04% by weight of Si, 0.15% by weight of Mn, 0.006% by weight of S, 0.0303% by weight of acid sol. Al, 0.0082% by weight of N and Sn in an amount of ① 0.002% by weight, ② 0.07% by weight and ③ 0.30% by weight with the balance consisting of Fe and unavoidable impurities were heated at 1150° C. and hot-rolled to form hot-rolled sheets having a thickness of 1.8 mm.

The hot-rolled sheets were subjected to annealing in such a manner that they were held at 1200° C. for 30 sec, held at 900° C. for 30 sec and then rapidly cooled. Thereafter, the steel sheets were cold-rolled with a reduction ratio of about 90.6% to provide cold-rolled sheets having a thickness of 0.170 mm which were then held at 835° C. for 70 sec to effect decarbonization annealing. Then, they were annealed by holding them at a temperature of 750° C. for 30 sec while introducing $NH_3$ gas into the annealing atmosphere to nitride the steel sheets. In this case, the degree of nitriding (increase in the nitrogen content) was 0.0132% by weight, and the average grain diameter of the steel sheets after the nitriding was 23 to 25 μm (in terms of the diameter of a circle with the same area as the grain has). The steel sheets after nitriding were coated with an annealing separator composed mainly of MgO and subjected to final annealing in such a manner that they were heated to 1200° C. at a rate of 15° C./hr and held at 1200° C. for 20 hr in $H_2$. In the final annealing, the steel sheets were treated in an annealing atmosphere comprising 25% of $N_2$ and 75% of $H_2$ until the temperature reached 880° C. in the heating stage, and then treated in an atmosphere comprising 75% of $N_2$ and 25% of $H_2$ in a temperature range of from 880° to 1200° C.

The relationship between the process conditions and the magnetic property is given in Table 8. As is apparent from Table 8, all the experimental conditions satisfy the requirement specified in the present invention, and a good magnetic property of $B_8 \geqq 1.92$ T was obtained. In particular, sample 24 having a Sn content falling within the scope of the present invention had a better magnetic property of $B_8$=1.94 T.

TABLE 8

| Sample No. | Sn | $B_8$ (T) | Remarks |
|---|---|---|---|
| 23 | ① | 1.92 | Invention |
| 24 | ② | 1.94 | Invention |
| 25 | ③ | 1.92 | Invention |

Example 6

Two types of 40 mm-thick slabs comprising 0.058% by weight of C, 3.68% by weight of Si, 0.14% by weight of Mn, 0.006% by weight of S, 0.039% by weight of acid sol. Al, 0.0088% by weight of N and Sn in an amount of ① 0.001% by weight and ② 0.05% by weight with the balance consisting of Fe and unavoidable impurities were heated at 1150° C. and hot-rolled to form hot-rolled sheets having a thickness of 1.8 min.

The hot-rolled sheets were cold-rolled to a thickness of 1.4 mm, and then subjected to annealing in such a manner that they were held at 1120° C. for 30 sec, held at 900° C. for 30 sec and then rapidly cooled. Thereafter, the steel sheets were cold-rolled with a reduction ratio of about 89.6% to provide cold-rolled sheets having a thickness of 0.145 mm which were then held at 830° C. for 70 sec to effect decarbonization annealing. Then, they were annealed by holding them at a temperature of 750° C. for 30 sec while introducing $NH_3$ gas into the annealing atmosphere to nitride the steel sheets. In this case, the degree of nitriding (increase in the nitrogen content) was 0.0131 to 0.0142% by weight, and the average grain diameter of the steel sheets after the nitriding was 24 to 25 μm (in terms of the diameter of a circle with the same area as the grain has). The steel sheets after nitriding were coated with an annealing separator composed mainly of MgO and subjected to final annealing in such a manner that they were heated to 1200° C. at a rate of 10° C./hr and held at 1200° C. for 20 hr in $H_2$. In the final annealing, the steel sheet was treated in an annealing atmosphere comprising 20% of $N_2$ and 80% of $H_2$ until the temperature reached 900° C. in the heating stage, and then treated in an atmosphere comprising 75% of $N_2$ and 25% of $H_2$ in a temperature range of from 900° to 1200° C.

The relationship between the process conditions and the magnetic property is given in Table 9. As is apparent from Table 9, all the experimental conditions satisfy the requirements specified in the present invention, and a good magnetic property of $B_8 \geqq 1.92$ T was obtained. Further, sample No. 27 having a Sn content falling within the scope of the present invention had a better magnetic property of $B_8$=1.94 T.

TABLE 9

| Sample No. | Sn | $B_8$ (T) | Remarks |
|---|---|---|---|
| 26 | ① | 1.92 | Invention |
| 27 | ② | 1.94 | Invention |

Example 7

A 1.7 mm-thick hot-rolled sheet comprising 0. 056% of C, 3.5% of Si, 0.12% of Mn, 0.008% of S, 0.032% of sol. Al, 0.0078% of N and 0.08% of Cr was pickled and preliminary cold-rolled under the following conditions.

Preliminary cold rolled sheet thickness (mm) (reduction ratio: %)

① None (0)

② 1.4 mm (17.6)

③ 1.2 mm (29.4)

④ 0.8 mm (52.9)

These Preliminary cold-rolled sheets were subjected to annealing under conditions of 1100° C.×2.5 min+900° C.×2 min, rapidly cooled, pickled and cold-rolled to a thickness of 0.12 mm. In the cold-rolling, aging was effected between passes at 200° C. for 5 min. Then, the steel sheets were subjected to decarbonization annealing at 830° C. for 70 sec in a D.P. of 60° C. comprising 75% of $H_2$ and 25% of $N_2$.

Thereafter, the steel sheets were subjected to a nitriding treatment at 750° C. for 30 sec in a dry atmosphere comprising 75% of $H_2$ and 25% of $N_2$ to regulate the N content to 110 ppm, 180 ppm and 240 ppm. The average diameter of primary recrystallized grains was about 22 μm. Thereafter, the steel sheets were coated with a slurry composed mainly of MgO and $TiO_2$ and subjected to final annealing in an atmosphere comprising 25% of $N_2$ and 75% of $H_2$ in a temperature range to 1200° C. and annealed at 1200° C. for 20 hr in $H_2$.

The magnetic property (B8 (T)) is given in Table 10.

TABLE 10

| Sample No. | N content (ppm) | Reduction Ratio in Preliminary cold-rolling (%) 0 | 17.6 | 29.4 | 52.9 |
|---|---|---|---|---|---|
| | | $B_8$ (T) | | | |
| 28 | 110 | Poor Secondary Recrystallization | Same as Left | Same as Left | Same as Left |
| 29 | 180 | 1.89 | 1.94 | 1.94 | 1.89 |
| 30 | 240 | 1.89 | 1.93 | 1.93 | 1.88 |

As is apparent from Table 10. the thickness of the product sheets is very small, and a high $B_8$ can be obtained even when the sheet thickness is as small as 0.12 mm.

Example 8

A slab comprising 0.054% of C, 3.25% of Si, 0.10% of Mn, 0.006% of S, 0.030% of sol. Al, 0.0075% of N, 0.07% of Sn and 0.12% of Cr was heated to 1150° C. and hot-rolled to form hot-rolled sheets having thicknesses of 2.5 mm, 2.0 mm and 1.8 mm. These hot-rolled sheets were pickled and preliminary cold-rolled under conditions specified in Table 11.

TABLE 11

| Sample No. | Thickness of Hot-Rolled Sheet (mm) | Thickness of Preliminary Cold-Rolled Sheet (mm) | (Reduction Ratio in Cold-Rolling, %) |
|---|---|---|---|
| 31 | 2.5 | 1.2 | (52) |
| 32 | 2.0 | 1.2 | (40) |
| 33 | 1.8 | 1.2 | (33) |

These preliminary cold-rolled sheets were subjected to annealing under conditions of 1100° C.×2.5 min+900° C.×2 min, rapidly cooled, pickled and cold-rolled to a thickness of 0.15 mm. In the cold-rolling, aging was effected between passes at 200° C. for 5 min. Then, the steel sheets were subjected to decarbonization annealing at 835° C. for 70 sec in a D.P. of 60° C. comprising 75% of $H_2$ and 25% of $N_2$.

Thereafter, the steel sheets were subjected to a nitriding treatment at 750° C. for 30 sec in a dry atmosphere comprising 75% of $H_2$ and 25% of $N_2$ to regulate the N content to about 200 ppm. The average diameter of primary recrystallized grains was about 23 μm. Thereafter, the steel sheets were coated with a slurry composed mainly of MgO and $TiO_2$ and subjected to final annealing at 1200° C. for 20 hr under the same condition as described in Example 7.

The magnetic property ($B_8$ (T)) is given in Table 12.

TABLE 12

| Sample No. | $B_8$ (T) |
|---|---|
| 31 | 1.88 |
| 32 | 1.92 |
| 33 | 1.94 |

A high $B_8$ value could not be obtained for sample No. 31 wherein the reduction ratio in the preliminary cold-rolling was as high as 52%, whereas sample Nos. 32 and 33 exhibited a high $B_8$ value.

Example 9

Steel slabs respectively containing chemical compositions ② and ③ in Example 1 and subjected from hot-rolling to nitriding under the same condition as described in Example 1 were coated with an annealing separator on three levels, that is, (a) an annealing separator comprising 100 parts by weight of MgO+10 parts by weight of $SnCl_2$, (b) 100 parts by weight of MgO+5 parts by weight of $CaCl_2$+5 parts by weight of SrS, and (c) an annealing separator comprising 100 parts by weight of MgO+3 parts by weight of NaCl+3 parts by weight of $BASO_4$+4 parts by weight of $K_2CO_3$, and subjected to final annealing in such a manner that they were heated to 1200° C. at a rate of 10° C./hr and held at 1200° C. for 20 hr. In this case, the atmosphere during the heating stage comprised 75% of $N_2$ and 25% of $H_2$, and the atmosphere during holding at 1200° C. comprised 100% of $H_2$. The steel sheets were subjected to known tension coating and magnetic domain control with laser. The results of measurement of the magnetic property in this experiment are given in Table 13.

TABLE 13

| Sample No. | Chemical Composition | Al (%)/ Si (%) | Annealing Separator | $B_8$ (T) | $W_{17/50}$ (w/kg) | Remarks |
|---|---|---|---|---|---|---|
| 34 | ② | 0.0087 | (a) | 1.95 | 0.69 | Invention |
| 35 | ② | 0.0087 | (b) | 1.97 | 0.66 | Invention |
| 36 | ② | 0.0087 | (c) | 1.96 | 0.68 | Invention |
| 37 | ③ | 0.0101 | (a) | 1.97 | 0.65 | Invention |
| 38 | ③ | 0.0101 | (b) | 1.97 | 0.65 | Invention |
| 39 | ③ | 0.0101 | (c) | 1.96 | 0.67 | Invention |

Sample Nos. 34 to 39 falling within the scope of the present invention had a very good magnetic property of $B_8 \geqq 1.95$ T.

Example 10

A steel slab containing chemical compositions ③ in Example 1 and subjected from hot-rolling to nitriding under the same condition as described in Example 1 was subjected to (a) pickling or (b) no pickling, subjected to electrostatic coating with an annealing separator comprising 100 parts by weight of $Al_2O_3$ and, added thereto, (A) no $TiO_2$ or (B) 10% of $TiO_2$, and subjected to final annealing, tension coating and magnetic domain control in the same manner as that of Example 9.

The results of measurement of the magnetic property in this experiment are given in Table 14.

TABLE 14

| Sample No. | Picking Conditions | $TiO_2$ Addition Conditions | $B_8$ (T) | $W_{17/50}$ (w/kg) | Remarks |
|---|---|---|---|---|---|
| 40 | (a) | (A) | 1.96 | 0.64 | Invention |
| 41 | (a) | (B) | 1.97 | 0.62 | Invention |
| 42 | (b) | (A) | 1.96 | 0.64 | Invention |
| 43 | (b) | (B) | 1.97 | 0.63 | Invention |

All the samples exhibited a very good magnetic property of $B_8 \geqq 1.96$ T.

Example 11

A steel slab comprising chemical compositions described in Example 4 and subjected from hot-rolling to nitriding under the same condition as described in Example 4 was coated with an annealing separator on the three levels described in Example 9 and subjected to final annealing in the same manner as that of Example 9 and then subjected to known magnetic domain control using a sprocket roll followed by tension coating and stress relief annealing.

The results of measurement of the magnetic property in this experiment are given in Table 15.

TABLE 15

| Sample No. | Annealing Separator Conditions | $B_8$ (T) | $W_{17/50}$ (w/kg) | Remarks |
|---|---|---|---|---|
| 44 | (a) | 1.93 | 0.65 | Invention |
| 45 | (b) | 1.95 | 0.62 | Invention |
| 46 | (c) | 1.94 | 0.65 | Invention |

All the samples exhibited a very good magnetic property of $B_8 \geqq 1.93$ T.

Example 12

A steel slab comprising chemical compositions described in Example 4 and subjected from. hot-rolling to nitriding under the same condition as described in Example 4 was subjected to a series of treatments up to final annealing in the same manner as that of Example 9 and then subjected to known magnetic domain control using a sprocket roll followed by tension coating and stress relief annealing.

The results of measurement of the magnetic property in this experiment are given in Table 16.

TABLE 16

| Sample No. | Pickling Conditions | $TiO_2$ Addition Conditions | $B_8$ (T) | $W_{17/50}$ (w/kg) | Remarks |
|---|---|---|---|---|---|
| 47 | (a) | (A) | 1.94 | 0.62 | Invention |
| 48 | (a) | (B) | 1.95 | 0.60 | Invention |
| 49 | (b) | (A) | 1.95 | 0.51 | Invention |
| 50 | (b) | (B) | 1.95 | 0.60 | Invention |

All the sample Nos. 47 to 50 exhibited a very good magnetic property of $B_8 \geqq 1.94$ T.

Example 13

A steel slab sample 33 subjected from hot-rolling to nitriding under the same condition described in Example 8 was coated with an annealing separator on the three levels described in Example 9 and subjected to final annealing in the same manner as that of Example 9 and then subjected to known magnetic domain control using a sprocket roll followed by tension coating and stress relieving annealing.

The results of measurement of the magnetic property in this experiment are given in Table 17.

TABLE 17

| Sample No. | Annealing Separator Conditions | $B_8$ (T) | $W_{17/50}$ (w/kg) | Remarks |
|---|---|---|---|---|
| 51 | (a) | 1.95 | 0.61 | Invention |
| 52 | (b) | 1.97 | 0.58 | Invention |
| 53 | (c) | 1.95 | 0.62 | Invention |

As is apparent from Table 17, all the sample Nos. 51 to 53 exhibited a very good magnetic property of $B_8 \geqq 1.95$ T.

Example 14

A steel slab sample 33 subjected from hot-rolling to nitriding under the same condition described in Example 8 was subjected to a series of treatments up to final annealing in the same manner as that of Example 9 and then subjected to known magnetic domain control using a sprocket roll followed by tension coating and stress relief annealing.

The results of measurement of the magnetic property in this experiment are given in Table 18.

TABLE 18

| Sample No. | Pickling Conditions | $TiO_2$ Addition Conditions | $B_8$ (T) | $W_{17/50}$ (w/kg) | Remarks |
|---|---|---|---|---|---|
| 54 | (a) | (A) | 1.95 | 0.57 | Invention |
| 55 | (a) | (B) | 1.96 | 0.56 | Invention |
| 56 | (b) | (A) | 1.96 | 0.55 | Invention |
| 57 | (b) | (B) | 1.97 | 0.54 | Invention |

All the samples 54 to 57 exhibited a very good magnetic property of $B_8 \geqq 1.95$ T.

We claim:

1. A process for producing a grain oriented electrical steel sheets having excellent magnetic properties, comprising the steps of:

heating a slab comprising, in terms of by weight, 0.025 to 0.075% of C, 3.4 to 5.0% of Si, 0.015 to 0.080% of sol. Al, 0.0030 to 0.013% of N, 0.014% or less of (S+0.405 Se) and 0.05 to 0.8% of Mn, sol. Al (%)/Si (%) being 0.0080 or more, with the balance consisting of Fe and unavoidable impurities at a temperature below 1280° C.;

hot-rolling the heated slab;

subjecting the hot-rolled steel sheet to cold rolling including final rolling with a reduction ratio of 80% or more once or at least twice with intermediate annealing between cold rolling;

subjecting the final cold-rolled steel sheet to decarbonization annealing with regulating the average diameter of primary recrystallized grains of the steel sheet subjected to decarbonization annealing to 18 to 35 μm in a period between the completion of the decarbonization annealing and the initiation of final annealing;

coating the steel sheet subjected to decarbonization annealing with an annealing separator and subjecting the coated steel sheet to final annealing wherein the final annealing is effected in such a manner that the partial pressure of nitrogen, $P_{N2}$ (%), in an annealing atmosphere in a final annealing furnace is 12.5% or more in a steel sheet temperature range of from 900° C. to 1150° C. in the heating stage of the final annealing; and subjecting the steel sheet to nitriding to cause the steel sheet to absorb 0.0010% by weight or more of nitrogen in a period between the completion of the hot rolling and the initiation of secondary recrystallization in the final annealing.

2. The process according to claim 1, wherein said slab further comprises at least one member selected from the group consisting of 0.01 to 0.15% of Sn and 0.03 to 0.20% of Cr.

3. The process according to claim 1, wherein the final annealing is effected in such a manner that the partial pressure of nitrogen, $P_{N2}$ (%), in an annealing atmosphere in a final annealing furnace is in the following range in a steel sheet temperature range of from 900° to 1150° C. in the heating stage of the final annealing:

$$P_{N2} \text{ value } (\%) \geqq 15 \times Si\ (\%) - 25$$

wherein Si (%) represents the Si content in % by weight of the slab.

4. The process according to claim 1, wherein the final annealing is effected in such a manner that the partial pressure of nitrogen, $P_{N2}$ (%), in an annealing atmosphere in a final annealing furnace is 30% or more in a steel sheet temperature range of from 900° to 1150° C. in the heating stage of the final annealing.

5. The process according to claim 1, wherein said hot-rolled steel sheet is preliminary cold-rolled with a reduction ratio of 10 to 50% and subjected to intermediate annealing and then subjected to final cold rolling including final rolling with a reduction ratio of 80% or more to form a cold-rolled sheet having a thickness in the range of from 0.10 to 0.25 mm.

6. The process according to claim 1, wherein the surface of said steel sheet subjected to decarbonization annealing is coated with an annealing separator comprising 100 parts by weight of MgO and, added thereto, 2 to 30 parts by weight in total of at least one member selected from the group consisting of chlorides, nitrates, sulfides and sulfates of Li, K, Na, Ba, Ca, Mg, Zn, Fe, Zr, Sr, Sn and Al.

7. The process according to claim 1, wherein the surface of said steel sheet subjected to decarbonization annealing is coated with an annealing separator composed mainly of at least one member selected from the group consisting of $Al_2O_3$, $SiO_2$, $ZrO_2$, BaO, CaO and SrO and subjected to final annealing in such a manner that secondary recrystallization and purification are effected with the surface of the steel sheet being in a specular state after final annealing.

8. The process according to claim 1, wherein the surface of said steel sheet subjected to decarbonization annealing is coated with an annealing separator comprising $Al_2O_3$ as a main component and, added thereto, 5 to 30% by weight of $TiO_2$ and subjected to final annealing in such a manner that secondary recrystallization and purification are effected with the surface of the steel sheet being in a specular state after final annealing.

9. The process according to claim 6, wherein an oxide layer present on the surface layer of the steel sheet subjected to decarbonization annealing is removed.

10. The process according to claim 1 or 2, wherein said hot rolled steel sheet is cold-rolled before annealing.

* * * * *

UNITED STATES PATENT AND TRADEMARK OFFICE

CERTIFICATE OF CORRECTION

PATENT NO. : 5,512,110

DATED : April 30, 1996

INVENTOR(S) : Yasumari YOSHITOMI, et al.

It is certified that error appears in the above-indentified patent and that said Letters Patent is hereby corrected as shown below:

Column 1, line 23, change "less" to --loss--.

Column 1, line 26, change "less" to --loss--.

Column 3, line 25, change "$Si_{02.}$" to --$SiO_2$.--.

Column 3, line 39, delete "a" before "characteristics".

Column 4, line 39, change "SiO2" to --$SiO_2$.--.

Column 5, line 26, change "0,006" to --0.006--.

Column 5, line 64, change "explained the case shown the" to --explained in the case shown in the--.

Column 6, line 20, change "AlN" to --AlN--.

Column 8, line 43, change "10ss" to --loss--.

Column 15, line 57, delete "the" at end of line.

UNITED STATES PATENT AND TRADEMARK OFFICE

CERTIFICATE OF CORRECTION

PATENT NO. : 5,512,110

DATED : April 30, 1996

INVENTOR(S) : Yasumari YOSHITOMI, et al.

It is certified that error appears in the above-indentified patent and that said Letters Patent is hereby corrected as shown below:

Column 25, line 20, delete "a" before "grain".

Signed and Sealed this

Twenty-second Day of April, 1997

Bruce Lehman

*Attest:*

BRUCE LEHMAN

*Commissioner of Patents and Trademarks*

*Attesting Officer*